US008388119B2

(12) United States Patent
Nishimori

(10) Patent No.: US 8,388,119 B2
(45) Date of Patent: Mar. 5, 2013

(54) LIQUID CONTAINER AND IMAGE FORMING APPARATUS INCLUDING THE LIQUID CONTAINER

(75) Inventor: Takehiro Nishimori, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 12/891,054

(22) Filed: Sep. 27, 2010

(65) Prior Publication Data

US 2011/0096129 A1 Apr. 28, 2011

(30) Foreign Application Priority Data

Oct. 22, 2009 (JP) ..... 2009-243642

(51) Int. Cl.
*B41J 2/17* (2006.01)

(52) U.S. Cl. ..... 347/84

(58) Field of Classification Search ..... 347/84
See application file for complete search history.

(56) References Cited

U.S. PATENT DOCUMENTS

| | | | | |
|---|---|---|---|---|
| 6,015,210 | A | 1/2000 | Kanematsu et al. | |
| 6,042,225 | A | 3/2000 | Altendorf et al. | |
| 6,050,681 | A | 4/2000 | Yamashita et al. | |
| 6,325,496 | B1 * | 12/2001 | Kageyama et al. | 347/85 |
| 6,554,412 | B1 | 4/2003 | Seino et al. | |
| 2004/0100540 | A1 | 5/2004 | Hatasa et al. | |
| 2005/0068385 | A1 | 3/2005 | Nanjo et al. | |
| 2006/0152563 | A1 * | 7/2006 | Kumagai et al. | 347/86 |
| 2008/0094448 | A1 | 4/2008 | Sugahara | |
| 2008/0218571 | A1 | 9/2008 | Nishimori | |
| 2008/0231650 | A1 * | 9/2008 | Kojima et al. | 347/17 |
| 2009/0262152 | A1 * | 10/2009 | Tamaki | 347/7 |

FOREIGN PATENT DOCUMENTS

| | | | |
|---|---|---|---|
| CN | 1509883 | A | 7/2004 |
| CN | 101559672 | A | 10/2009 |
| EP | 1090767 | A2 | 4/2001 |
| EP | 1835213 | A1 | 9/2007 |
| GB | 2326846 | A | 1/1999 |
| JP | 2000-94708 | | 4/2000 |
| JP | 2005-96404 | | 4/2005 |
| JP | 2005-103858 | | 4/2005 |
| JP | 3833123 | | 10/2006 |
| JP | 2009-28979 | | 2/2009 |

OTHER PUBLICATIONS

Nov. 26, 2010 European search report in connection with counterpart European patent application No. 10 25 1629.
Apr. 6, 2011 European search report in connection with counterpart European patent application No. 10 25 1629.

* cited by examiner

*Primary Examiner* — Shelby Fidler
(74) *Attorney, Agent, or Firm* — Cooper & Dunham LLP

(57) ABSTRACT

A liquid container stores liquid to be supplied to a liquid ejection head. The liquid container includes a liquid storage chamber that stores externally supplied liquid, a first delivery channel through which the liquid is delivered from the liquid storage chamber to the liquid ejection head, and a second delivery channel through which the liquid is delivered from the liquid storage chamber to the liquid ejection head. The second delivery channel has an inlet positioned lower than an inlet of the first delivery channel in a height direction of the liquid storage chamber.

7 Claims, 10 Drawing Sheets

LIQUID CONTAINER AND IMAGE FORMING APPARATUS INCLUDING THE LIQUID CONTAINER

CROSS-REFERENCE TO RELATED APPLICATIONS

The present patent application claims priority pursuant to 35 U.S.C. §119 from Japanese Patent Application No. 2009-243642, filed on Oct. 22, 2009 in the Japan Patent Office, which is incorporated herein by reference in its entirety.

BACKGROUND OF THE DISCLOSURE

1. Field of the Disclosure

Exemplary embodiments of the present disclosure relate to a liquid container and an image forming apparatus including the liquid container.

2. Description of the Related Art

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that uses a recording head formed with a liquid ejection head (liquid-droplet ejection head) for ejecting droplets of ink.

Such image forming apparatuses employing the liquid-ejection recording method eject droplets of ink or other liquid from the recording head onto a recording medium to form a desired image (hereinafter "image formation" is used as a synonym for "image recording" and "image printing").

Such liquid-ejection-type image forming apparatuses fall into two main types: a serial-type image forming apparatus that forms an image by ejecting droplets from the recording head while moving the recording head in a main scan direction, and a line-head-type image forming apparatus that forms an image by ejecting droplets from a linear-shaped recording head held stationary in the image forming apparatus.

Such an image forming apparatus (hereinafter also simply "inkjet recording apparatus") may include, for example, a sub tank (also referred to as buffer tank or head tank, serving as a second liquid container) mounted on a carriage together with a recording head. In the image forming apparatus, an ink cartridge (main tank, serving as a first liquid container) is detachably attached to the image forming apparatus to supply and replenish ink from the ink cartridge to the sub tank.

The second liquid container and the recording head may be shipped either filled with ink or empty. However, if the second liquid container and the recording head filled with ink are stored for a long time, ink components may adhere to an area near nozzles of the recording head, thereby causing faulty ejection.

Alternatively, in a case in which the second liquid container and the recording head are empty when shipped, during initial ink filling air bubbles present in chambers of the recording head may cause faulty ejection.

Hence, for example, JP-2000-094708-A proposes filling the second liquid container and the recording head with another liquid besides ink (e.g., filler liquid or induction liquid). Then, by suctioning and discharging such liquid from the nozzles of the recording head in initial ink filling, ink is supplied from the first liquid container to the second liquid container to replace such liquid with ink.

In this regard, if liquid supplied to the second liquid container includes bubbles and such bubbles are supplied to the recording head, faulty droplet ejection, e.g., misdirected ejection or ejection clogging, can occur. For this reason, it is preferable that the second liquid container be able to store and exhaust air.

However, for a conventional second liquid container, liquid supplied from a first liquid container is stored in a liquid storage area and supplied from the liquid storage area to a recording head through a liquid discharge passage. For such a configuration, increasing the size of an air storage area for reserving air may make it much more difficult to replace the filler liquid with ink in the second liquid container. In other words, if a large area for reserving air is allocated in the second liquid container, a slow-current and stagnant area my arise, thereby causing reduced efficiency of replacing filler liquid with ink. Consequently, the amount of waste ink may increase. Further, if a large area is allocated to store air in the liquid container, the size of the entire liquid container may increase, thereby increasing the size of a head unit including the recording head and the liquid container as an integrated unit, which is undesirable.

Alternatively, if the second liquid container includes an air release mechanism that opens the interior of the second liquid container to the atmosphere, the configuration of the second liquid container may get complicated.

SUMMARY

In an aspect of this disclosure, there is provided an improved liquid container that stores liquid to be supplied to a liquid ejection head. The liquid container includes a liquid storage chamber that stores externally supplied liquid, a first delivery channel through which the liquid is delivered from the liquid storage chamber to the liquid ejection head, and a second delivery channel through which the liquid is delivered from the liquid storage chamber to the liquid ejection head. The second delivery channel has an inlet positioned lower than an inlet of the first delivery channel in a height direction of the liquid storage chamber.

In an aspect of this disclosure, there is provided an improved image forming apparatus including the liquid container described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
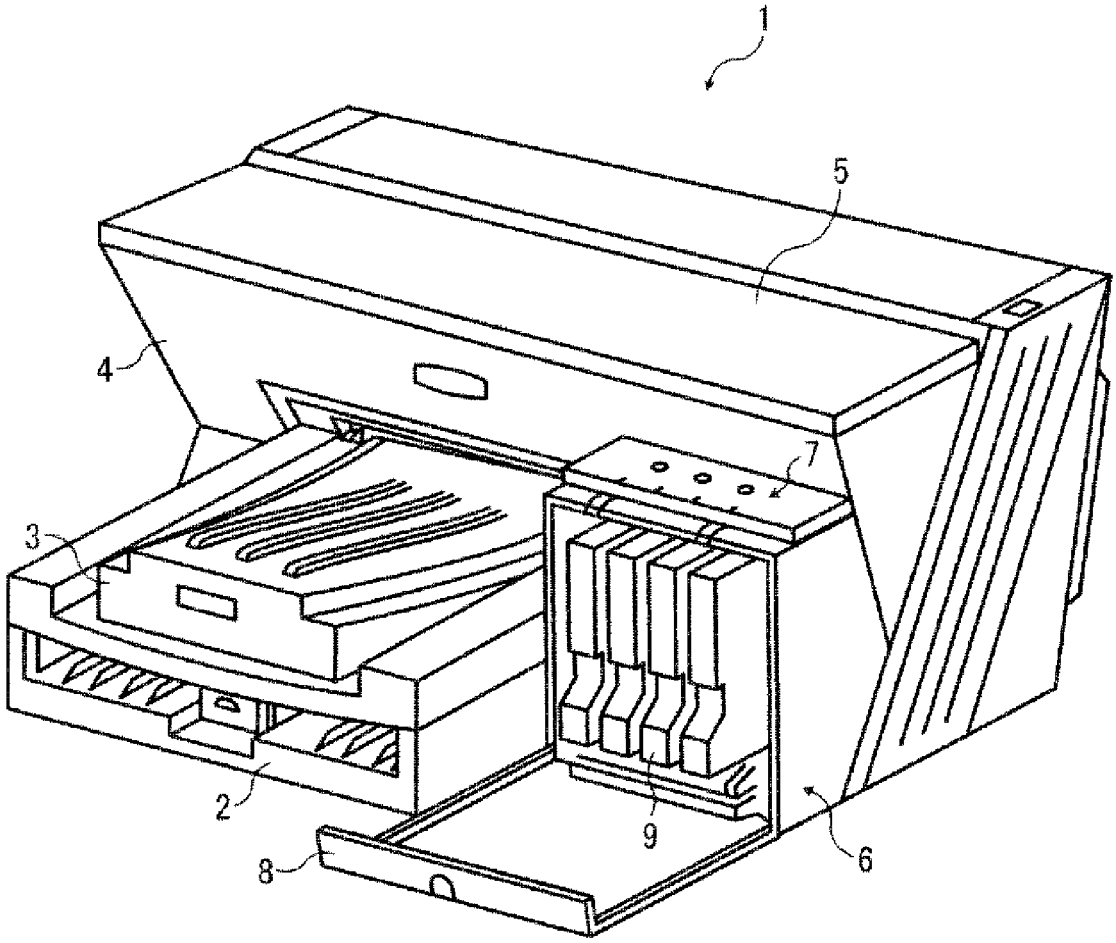
FIG. 1 is an external perspective view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Figure 2:
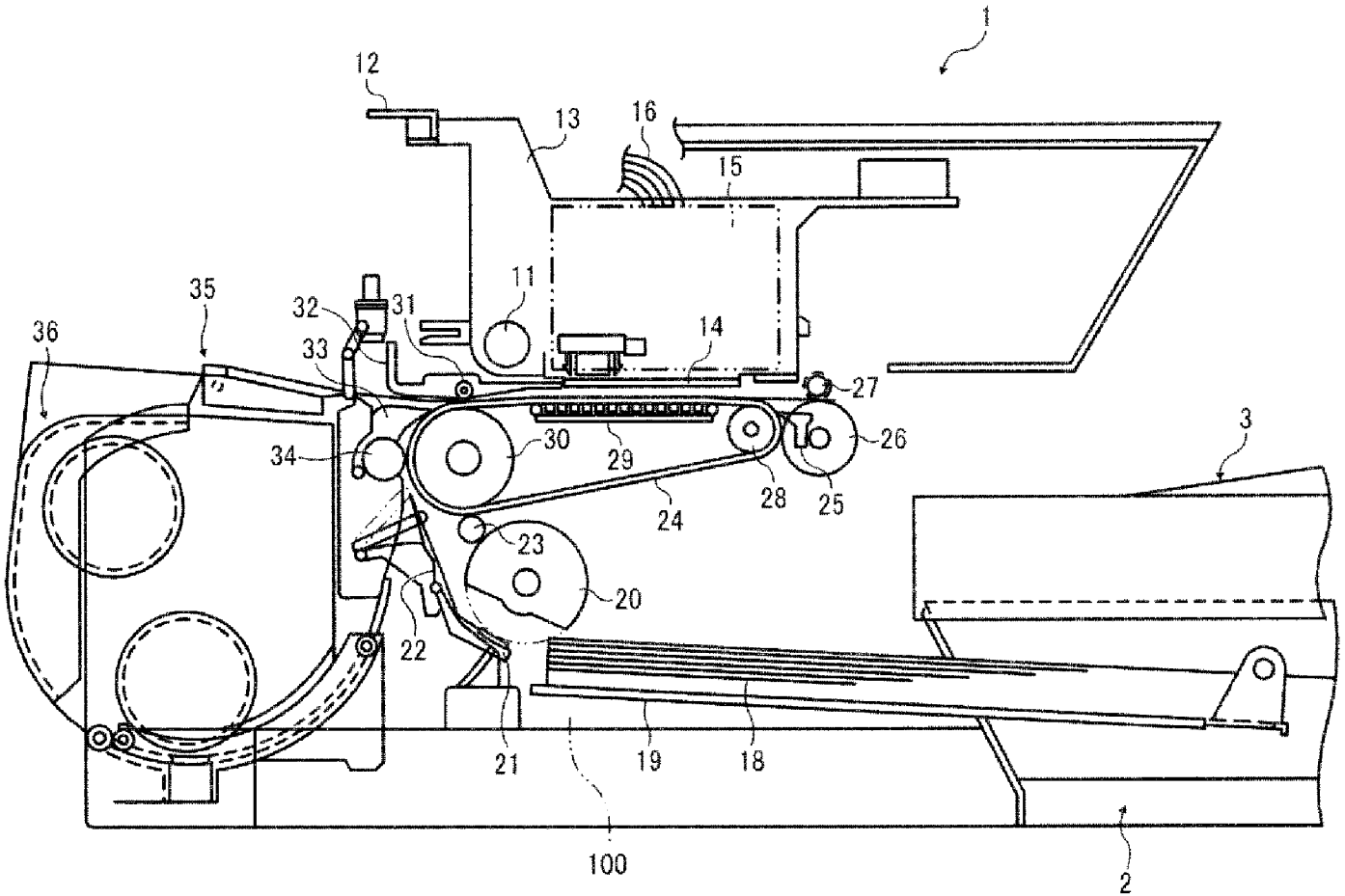
FIG. 2 is a side view of a printing section of the image forming apparatus illustrated in FIG. 1.
Figure 3:
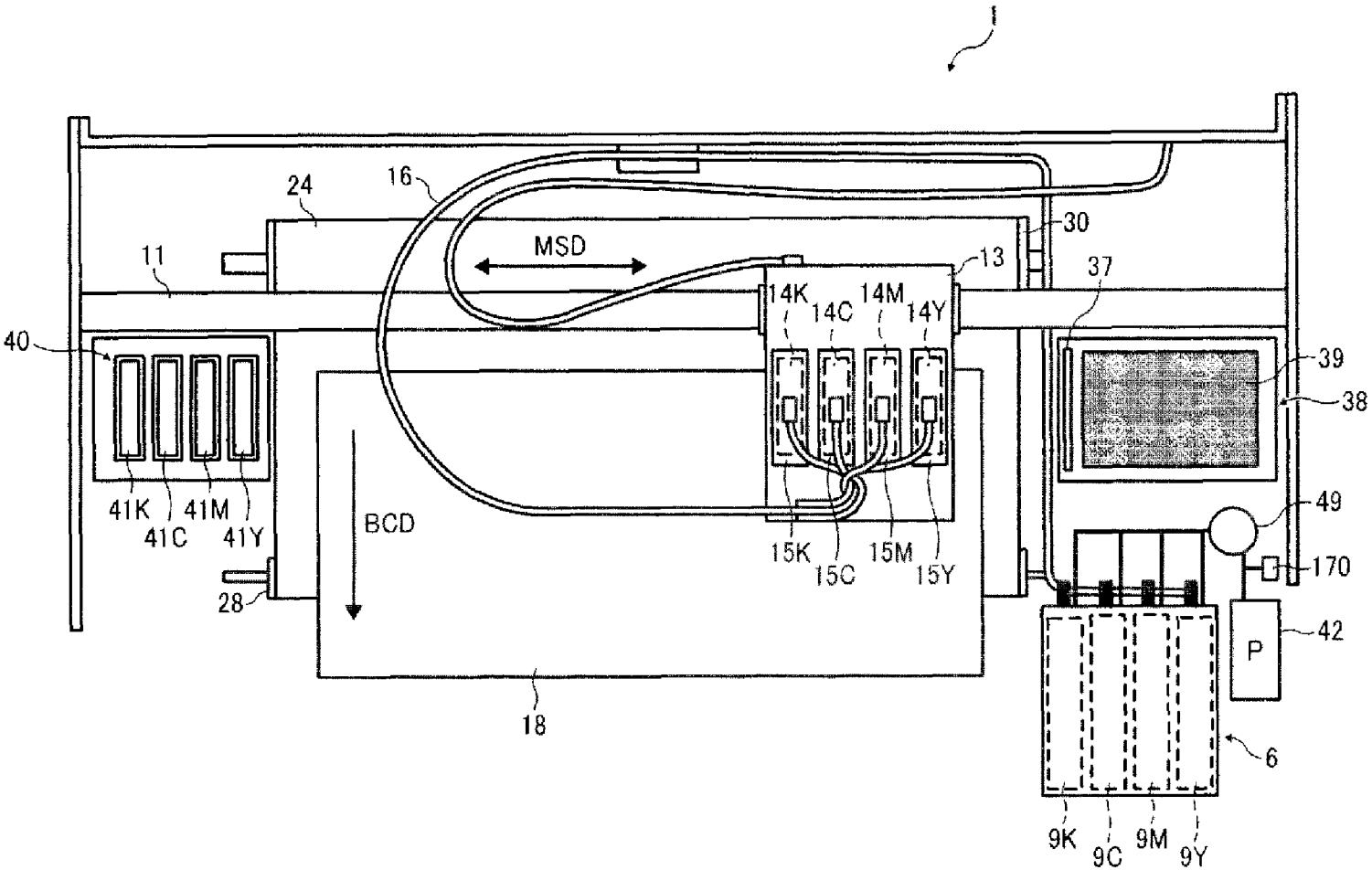
FIG. 3 is a plan view of a carriage and a recovery unit of the image forming apparatus illustrated in FIG. 1.

Referring now to the drawings, wherein like reference numerals designate identical or corresponding parts throughout the several views, in particular to FIGS. 1 to 3, an image forming apparatus 1 according to an exemplary embodiment of the present disclosure is explained.

FIG. 1 is a perspective view illustrating the image forming apparatus 1 seen from its front side. FIG. 2 is a schematic view illustrating an entire configuration of a mechanical section of the image forming apparatus 1. FIG. 3 is a plan view illustrating the mechanical section of the image forming apparatus 1.

As illustrated in FIG. 1, the image forming apparatus 1 includes a sheet feed tray 2, a sheet output tray 3, a main-tank install portion 6, and an operation unit 7. The sheet feed tray 2 is detachably mountable to the image forming apparatus 1 to store recording media, for example, sheets of paper (hereinafter simply "sheets"). The sheet output tray 3 is mounted to the image forming apparatus 1 to stack sheets on which images are recorded. At one end portion of a front face 4 of the image forming apparatus 1, the main-tank install portion 6 is disposed lower than a top face of the image forming apparatus 1 so as to protrude forward from the front face 4 of the image forming apparatus 1. On a top face of the main-tank install portion 6 is provided the operation unit 7 including operation buttons and indicators. The main-tank install portion 6 includes a front cover 8 that is opened and closed to install and remove main tanks 9 serving as first liquid containers.

As illustrated in FIGS. 2 and 3, a carriage 13 is supported by a guide rod 11 and a stay 12 so as to slide in a main scan direction indicated by a double arrow "MSD" illustrated in FIG. 3. The carriage 13 is moved by a main scan motor for scanning in the main scan direction MSD.

On the carriage 133 are mounted recording heads 14Y, 14M, 14C, and 14K (hereinafter referred to as "recording heads 14" unless colors are distinguished) that are four liquid ejection heads to eject droplets of different color inks of yellow (Y), cyan (C), magenta (M), and black (K). The recording heads 14 are mounted on the carriage 133 in such a manner that a plurality of ejection ports is arranged in a direction perpendicular to the main scan direction and ink droplets are ejected downward from the ejection ports.

As a pressure generator that generates pressure to eject droplets, the droplet ejection heads constituting the recording heads 134 may employ, for example, a piezoelectric actuator such as a piezoelectric element, a thermal actuator that generates film boiling of liquid (ink) using an electro/thermal converting element such as a heat-generation resistant to cause a phase change, a shape-memory-alloy actuator that changes metal phase by a temperature change, or an electrostatic actuator that generates pressure by electrostatic force.

In the present exemplary embodiment, as the recording heads 14, four recording heads (14Y, 14C, 14M, and 14K) are provided for different ink colors. Alternatively, it is to be noted that a single recording head having nozzles for ejecting different color inks or any number of recording heads fewer than the number of ink colors may be used.

On the carriage 133 is mounted a plurality of sub tanks 15Y, 15C, 15M, and 15K that supplies the different color inks to the recording heads 14. The plurality of sub tanks 15Y, 15C, 15M, and 15K (hereinafter referred to as simply "sub tanks 15" unless colors distinguished) serves as second liquid containers. The different color inks are supplied (refilled) from the main tanks 9Y, 9C, 9M, and 9K through a supply tube 16 constituting a liquid supply passage. The main tanks 9Y, 9C, 9M, and 9K contain yellow, cyan, magenta, and black ink, respectively. The sub tanks 15 are buffer tanks that temporarily store (reserve) liquid supplied from the main tanks 9 and supply the liquid to the recording heads 14.

A sheet feed section feeds sheets 18 stacked on a sheet stack portion (platen) 19 of the sheet feed tray 3. The sheet feed section further includes a sheet feed roller 20 that separates the sheets 18 from the sheet stack portion 19 and feeds the sheets 18 sheet by sheet and a separation pad 21 that is disposed opposite the sheet feed roller 20. The separation pad 21 is made of a material of a high friction coefficient and urged toward the sheet feed roller 20.

The image forming apparatus 1 further includes a sheet conveyance section that feeds the sheets 18 from the sheet feed section to a position below the recording heads 14. The sheet conveyance section includes a first guide member 22, a charging roller 23, a conveyance belt 24, a tension roller 28, a second guide member 29, a conveyance roller 30, a front-tip pressing roller 31, an urging member 32, a conveyance guide member 33, and a counter roller 34. The conveyance belt 24 electrostatically attracts and conveys the sheet 18. The counter roller 34 sandwiches the sheet 18, conveyed from the sheet feed section via the first guide member 22, between the conveyance belt 24 and it for feeding. The conveyance guide member 33 turns the sheet 18, conveyed in a substantially vertical direction, by substantially 90 degrees while guiding the sheet 18 along the conveyance guide member 33 turns the sheet 18. The front-tip pressing roller 31 is urged toward the conveyance belt 24 by the urging member 32. The charging roller 23 charges a surface of the conveyance belt 24.

The conveyance belt 24 is an endless belt that is looped between the conveyance roller 30 and the tension roller 28 so as to circulate in a belt conveyance direction (sub-scan direction) indicated by an arrow "BCD" illustrated in FIG. 3. The charge roller 23 is disposed so as to contact the surface of the conveyance belt 24 and rotate in accordance with the circulation of the conveyance belt 24. On the back side of the conveyance belt 24 is disposed the second guide member 29 at a position corresponding to a print area of the recording heads 14.

The image forming apparatus 1 further includes a sheet output section that outputs the sheet 18 on which an image has been formed by the recording heads 14. The sheet output section includes a separation claw 25 that separates the sheet 18 from the conveyance belt 24, a first output roller 26, a second output roller 27, and the sheet output tray 3 disposed below the first output roller 26.

A duplex unit 36 is detachably mountable on a rear portion of the image forming apparatus 1. When the conveyance belt 24 rotates in reverse to return the sheet 18, the duplex unit 36 receives the sheet 18. Then, the duplex unit 36 turns the sheet 18 upside down to feed the sheet 18 between the counter roller 34 and the conveyance belt 24. At the top face of the duplex unit 35 is formed a manual-feed tray 35.

As illustrated in FIG. 3, a recovery unit 38 is disposed at a non-print area that is located on one end in the main-scan direction of the carriage 13. The recovery unit 38 includes an air supply pump 42, an air release valve 49, a waste liquid container 39, and a wiper blade 37. The air supply pump 42 applies air pressure to the main tanks 9, and the air release valve 49 releases such air pressure to the atmosphere as needed. The waste liquid container 39 stores waste ink or liquid discharged before or during recording. The wiper blade 37 wipes a nozzle face of the recording heads 14.

As illustrated in FIG. 3, a capping device 40 is disposed at a non-print area opposite the print area in the main-scan direction of the carriage 133. The capping device 40 includes caps 41K, 41C, 41M, and 41K serving as capping (sealing) members that cover the nozzle face of the recording heads 14 to seal the nozzles of the recording heads 14.

Figure 4:
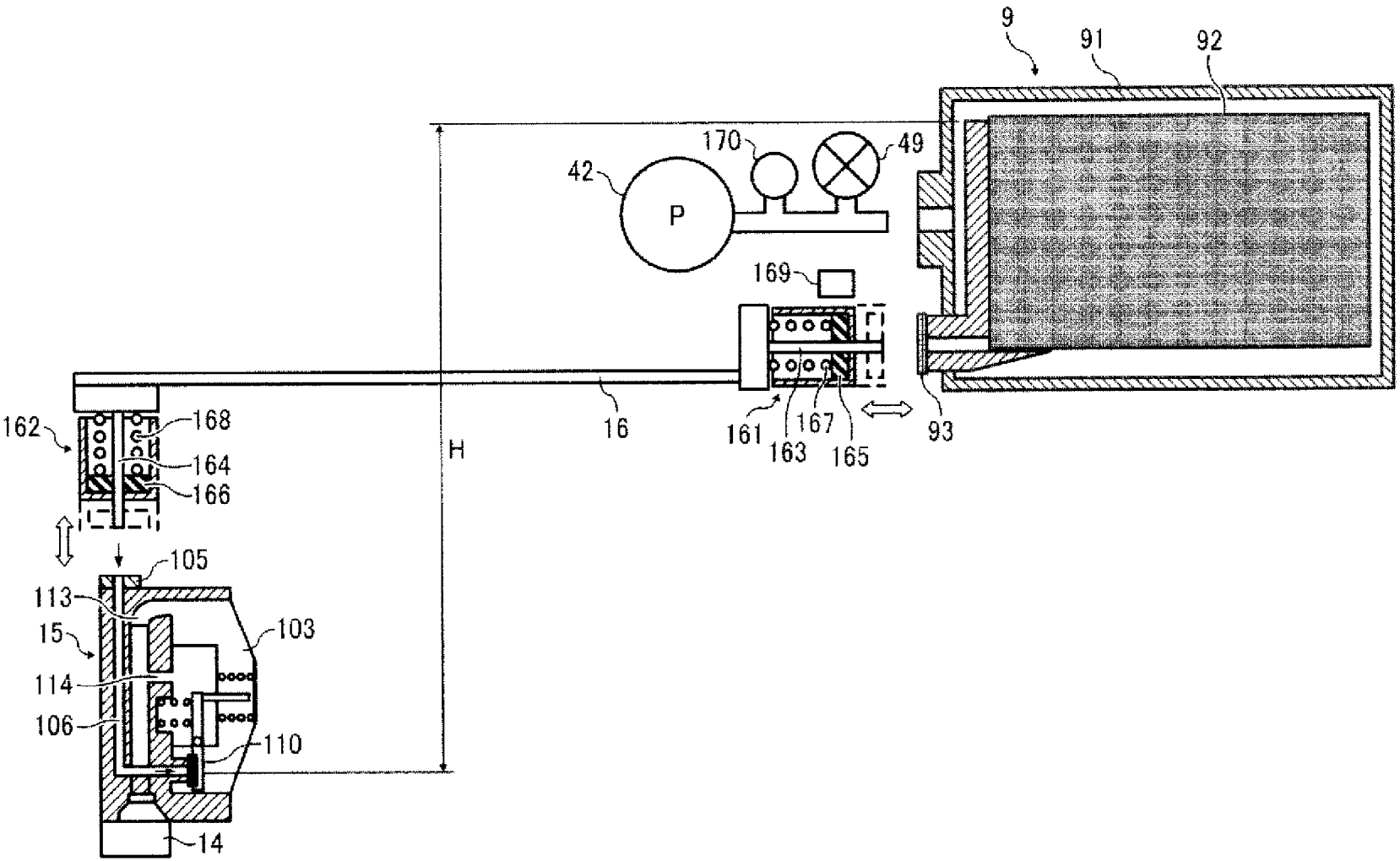
FIG. 4 is a schematic view of an ink supply system used in the image forming apparatus illustrated in FIG. 1.

Next, an entire configuration of an ink supply system of the image forming apparatus 1 is described with reference to FIG. 4. FIG. 4 is a schematic view of an ink supply system used in the image forming apparatus illustrated in FIG. 1.

In the ink supply system, ink is supplied from the main tank 9 serving as a first liquid container to the sub tank 15 serving as a second liquid container via the supply tube 16. Then, ink is supplied from the sub tank 15 to the recording head 14.

A main-tank housing 91 of the main tank 9 houses an ink bag 92 that is deformable under external pressure. A tank seal member 93 made of, for example, rubber is provided integrally with the main tank 9 at a portion that connects the supply tube 16 and the main tank 9.

At ends of the supply tube 16 are provided a first connection device 161 and a second connection device 162 to connect the supply tube 16 to each of the main tank 9 and the sub tank 15, respectively. The first connection device 161 and the second connection device 162 include a first supply needle 163 and a second supply needle 164, a first seal member 165 and a second seal member 166, and a first spring 167 and a second spring 168, respectively. When the first connection device 161 and the second connection device 162 are separated from the main tank 9 and the sub tank 15, respectively, the first seal member 165 and the second seal member 166, which are made of, for example, rubber, cover and protect the first supply needle 163 and the second supply needle 164 by elastic force of the first spring 167 and the second spring 168, respectively.

When the main tank 9 is installed in the image forming apparatus 1, the first supply needle 163 pierces the tank rubber seal member 93 to connect the ink bag 92 to the supply tube 16. At the same time, the main tank 9 is connected to the air supply pump 42 and the air release valve 49, both of which are provided in the image forming apparatus 1. The image forming apparatus 1 further includes a main-tank detector 169 that detects whether or not the main tank 9 is connected to the air supply pump 42 and the air release valve 49.

In the image forming apparatus 1, the main tank 9 is disposed higher than a conjunction valve 110 of the sub tank 15 by a height H indicated by a double arrow illustrated in FIG. 4. Thus, a supply passage from the ink bag 92 to the conjunction valve 110 is constantly maintained at positive pressure by liquid head difference, thereby suppressing intrusion of bubbles into the supply tube 16 even in a print-ready mode.

When a print command is inputted to the image forming apparatus 1, the air release valve 49 is closed and the air supply pump 42 is activated to supply air to the main tank 9. Thus, pressure is applied to the ink bag 92 and then to the interior of the supply tube 16 to supply ink through the supply tube 16. At this time, a passage pressure detector 170 drives the air supply pump 42 to obtain a predetermined pressure capable of stably supplying ink.

Figure 5:
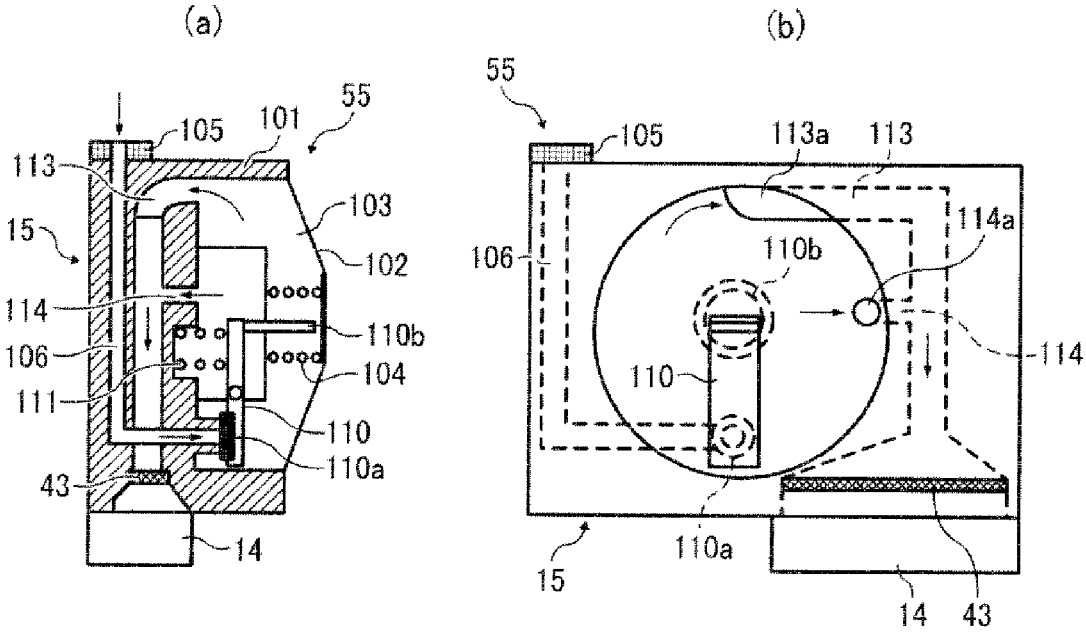
FIGS. 5*a* and 5*b* are schematic views of a sub tank (liquid container) according to a first exemplary embodiment of the present disclosure.

Next, the sub tank (liquid container) 15 according to a first exemplary embodiment of the present disclosure is described with reference to FIGS. 5*a* and 5*b*. FIG. 5*a* is a schematic cross-sectional view illustrating the sub tank 15. FIG. 5*b* is an elevation view illustrating the sub tank 15.

The recording head 14 is integrally provided with the sub tank 15 via a first filter 43 and constitutes a head unit 55 as a single integrated unit supported by the carriage 13.

In the sub tank 15, an opening of a sub-tank housing 101 formed in a concave shape is sealed with a flexible film 102 to form a storage chamber 103 serving as both a liquid storage chamber to store ink and an air storage chamber to store air within the sub tank 15. The flexible film 102 is urged outward by a first internal spring 104 serving as an elastic member. The sub-tank housing 101 is provided with a connecting portion (connection sealing member) 105 connected to the supply tube 16. The sub-tank housing 101 also includes an introduction passage (supply passage) 106 to introduce supplied ink to the storage chamber 103.

In the sub tank 15, the conjunction valve 110 is swingably provided to open and close an opening of the storage chamber 103 of the introduction passage 106 relative to the introduction passage 106 in accordance with a change in internal pressure of the recording head 14 caused by ink consumption involving with printing. For the conjunction valve 110, an elastic valve member 110*a* is formed by, for example, two-color molding. The conjunction valve 110 is urged in a direction to close the introduction passage 106 by a second internal spring 111 disposed within the sub tank 15. The conjunction valve 110 is provided with a pressed portion 110*a* pressed by the flexible film 102.

The sub-tank housing 101 includes a first delivery channel 113 through which ink is supplied from the storage chamber 103 to the recording head 14. An inlet 113*a* of the first delivery channel 113 is disposed at an upper position in the height direction of the storage chamber 103 at a state at which the sub tank 15 is installed in the image forming apparatus 1. The sub-tank housing 101 further includes a second delivery channel 114 that bypasses the inlet 113*a* of the first delivery channel 113 and through which ink is supplied from the storage chamber 103 to the recording head 14. An inlet 114*a* of the second delivery channel 114 is disposed at a substantially middle position in the height direction of the storage chamber 103. That is, the inlet 114*a* of the second delivery channel 114 is disposed lower than the inlet 113*a* of the first delivery channel 113 in the height direction of the storage chamber 103.

The second delivery channel 114 has a surface area and a cross-sectional opening area in a direction perpendicular to a direction in which ink flows through the second delivery channel 114 that are large enough to supply ink to the recording head 14 even when the first delivery channel 113 is closed (shut off). The cross-sectional opening area and length of each of the first delivery channel 113 and the second delivery channel 114 are set so that the second delivery channel 114 has a fluid resistance greater than a fluid resistance of the first delivery channel 113.

Next, operation of the conjunction valve 110 in the sub tank 15 is described with reference to FIGS. 6*a*, 6*b*, and 6*c*.

Figure 6:
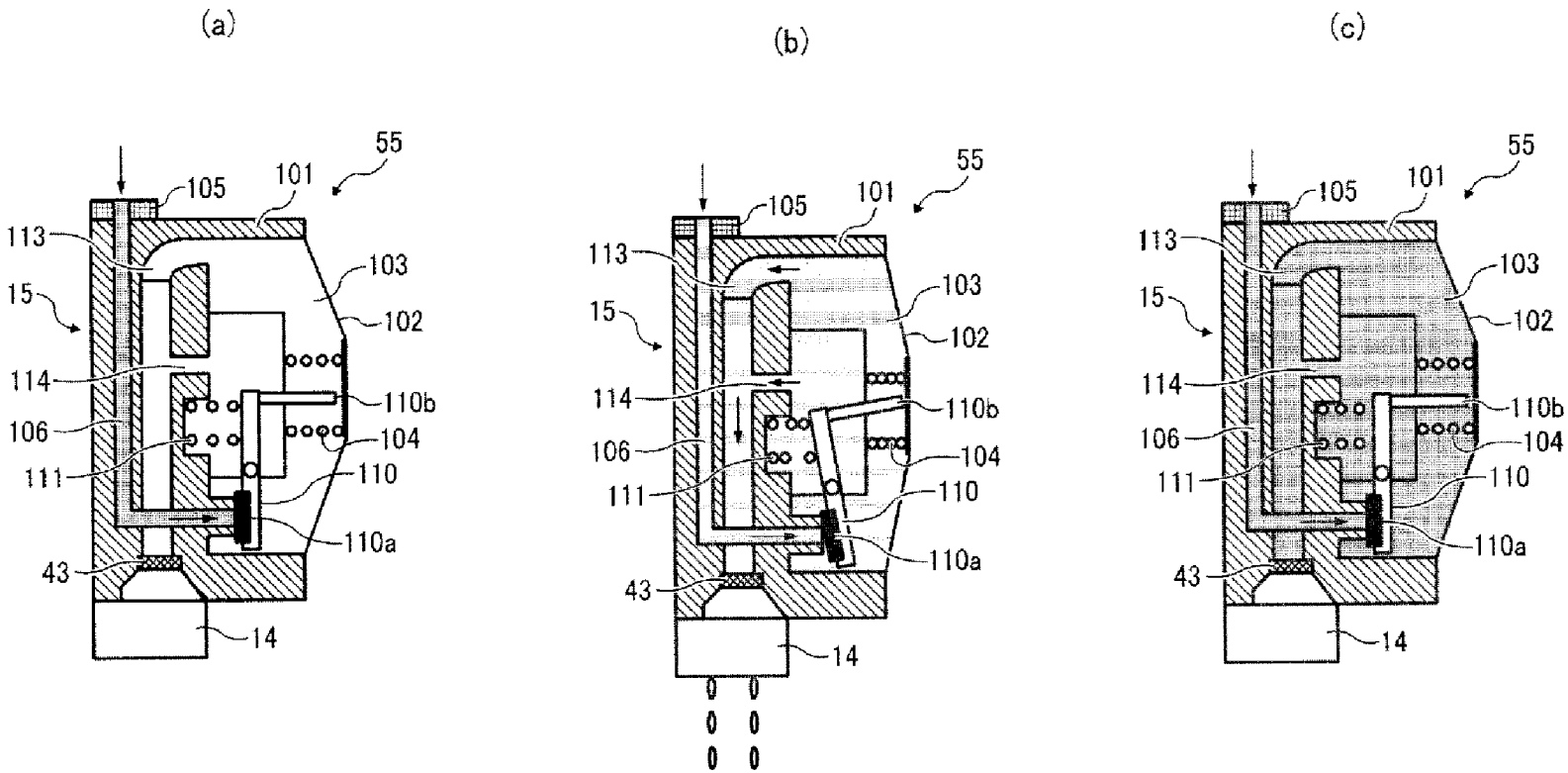
FIGS. 6*a*, 6*b*, and 6*c* illustrate operation of a conjunction valve of the sub tank illustrated in FIGS. 5*a* and 5*b;*

As illustrated in FIG. 6*a*, when ink is ejected from the recording head 14, the volume of ink stored in the storage chamber 103 decreases, and the flexible film 102 starts to deform. Further, when ink is continuously ejected, as illustrated in FIG. 6*b*, the flexible film 102 presses an end (the pressed portion 110*b*) of the conjunction valve 110, thereby swinging the conjunction valve 110. Accordingly, the valve member 110*a* opens the introduction passage 106, thereby causing ink to be supplied from the main tank 9 to the storage chamber 103 of the sub tank 15.

When ink ejection from the recording head 14 is stopped, as illustrated in FIG. 6*c*, the conjunction valve 110 returns to its original position by restoring force of the first spring 104 to close the introduction passage 106 of the sub tank 15. At this time, the flexible film 102 contacts the pressed portion 110*b* of the conjunction valve 110 to maintain the balance between a resultant force of the first internal spring 104 and the second internal spring 111 and an internal pressure of the sub tank 15.

Next, initial filling (hereinafter "initial ink filling") of the sub tank 15 and the recording head 14 with ink is described. Before initial ink filling is performed, the sub tank 15 and the recording head 14 are filled with a liquid (not including colorant) other than ink (hereinafter, "filler liquid").

When initial ink filling is performed, the nozzle face of the recording head 14 is covered with the capping member and suctioned by a suction unit to discharge the filler liquid of the recording head 14 and the sub tank 15 from the nozzles of the recording head 14. Thus, ink is supplied from the main tank 9 to both the sub tank 15 and the recording head 14 to replace the filler liquid therein.

At this time, since the fluid resistance of the first delivery channel 113 is lower than the fluid resistance of the second delivery channel 114, when the conjunction valve 110 is opened, more ink flows toward the first delivery channel 113 than the second delivery channel 114. In other words, the first delivery channel 113 forms a primary flow and the second delivery channel 114 forms a secondary flow.

Thus, two flows toward the first delivery channel 113 and the second delivery channel 114 occur in the storage chamber 103. Accordingly, ink flow occurs not only in an upper area of the storage chamber 103, in which otherwise the ink flow might stagnate, but also in the whole area of the two channels from the storage chamber 103 to the recording head 14. Such a configuration can reduce a stagnant area of ink flow in the sub tank 15, enhance the efficiency of replacing the filler liquid with ink, and reduce the amount of waste ink in replacement.

Next, a stored state of bubbles in the sub tank 15 is described with reference to FIGS. 7*a* and 7*b*, 8*a* and 8*b*, and 9*a* and 9*b*.

Figure 7:
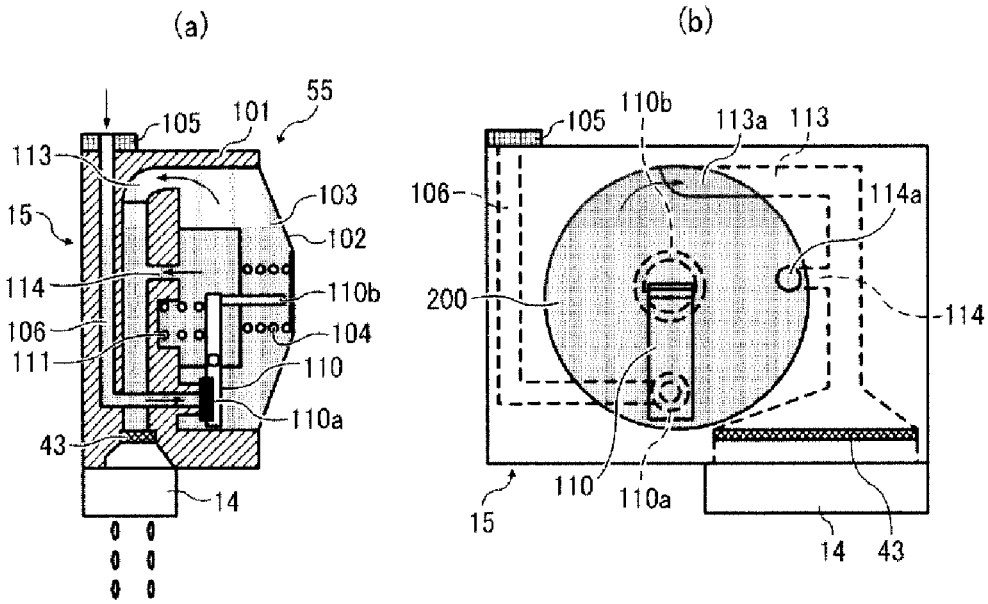
FIGS. 7*a* and 7*b* illustrate a state in which the sub tank is initially filled with ink.

FIGS. 7*a* and 7*b* illustrate a state in which the sub tank 15 and the recording head 14 are completely filled with ink just after initial ink filling. When the sub tank 15 is used for a long time, bubbles may enter the ink supply system from, for example, the supply tube 16, the first connection device 161, the second connection device 162, and/or other connection portions. When such bubbles are delivered together with ink to the storage chamber 103 of the sub tank 15, such bubbles starts to be stored in an upper portion of the storage chamber 103 by buoyant force.

Figure 8:
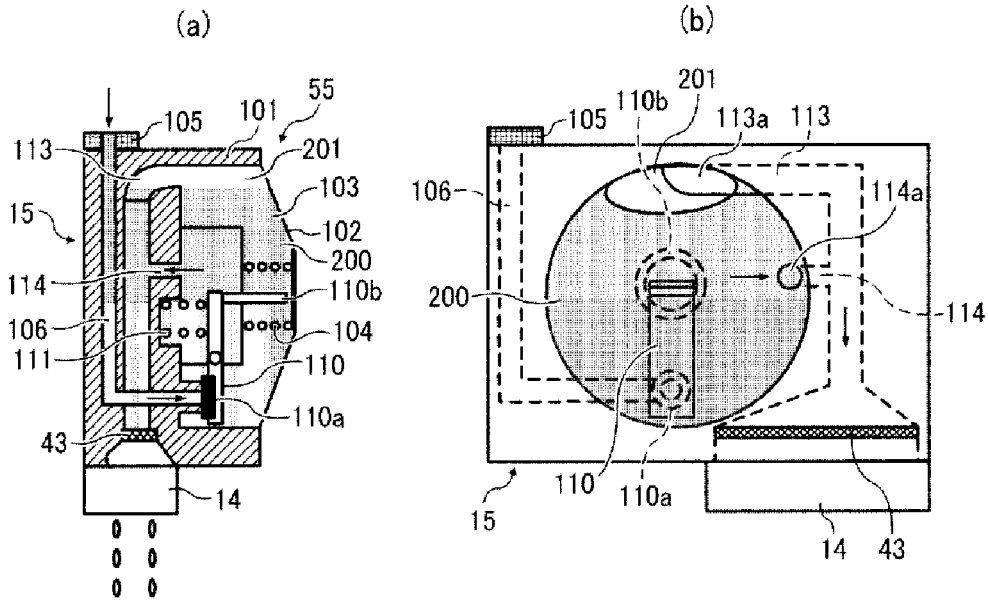
FIGS. 8*a* and 8*b* illustrate a state in which air is stored in the sub tank.

As illustrated in FIGS. 8*a* and 8*b*, when air bubbles 201 are stored in the upper portion of the storage chamber 103 of the sub tank 15, an inlet of the first delivery channel 113 is positioned in an area in which air 201 is stored. As a result, ink of the storage chamber 103 is not supplied through the first delivery channel 113, which is the same state as a state in which the first delivery channel 113 is blocked.

Figure 9:
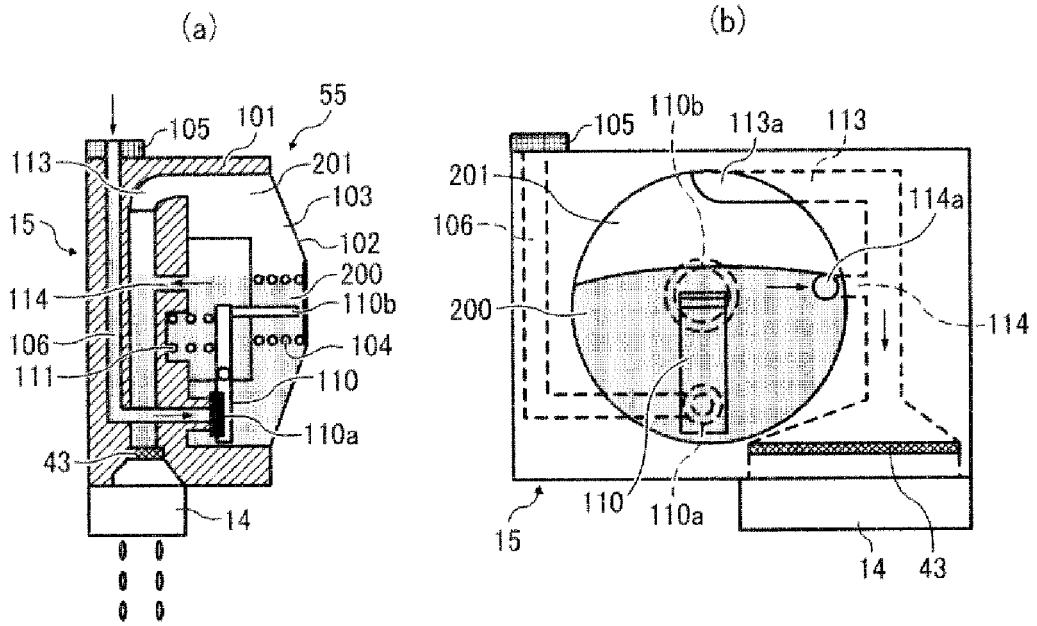
FIGS. 9*a* and 9*b* illustrate a state in which air is stored to a maximum amount capable of supplying liquid.

At this time, since the sub tank 15 is provided with the second delivery channel 114, as illustrated in FIGS. 9*a* and 9*b*, when the area in which air 201 is stored within the storage chamber 103 is above the inlet 114*a* of the second delivery channel 114, in other words, ink 200 is filled up to a position above the second delivery channel 114, ink 200 is supplied from the second delivery channel 114 to the recording head 14.

Thus, according to the present exemplary embodiment, a portion of the storage chamber 103 of the sub tank 15 and the first delivery channel 113 can be used as an air storage area in which bubbles (air) entering the storage chamber 103 are stored. Such a configuration can provide the air storage area (air storage space) to store a sufficient amount of air without increasing the whole size of the sub tank 15. In other words, the space above the second delivery channel 114 in the storage chamber 103 of the sub tank 15 serves as both the liquid storage area (liquid storage space) for reserving ink and the air storage area (air storage space).

Figure 13:
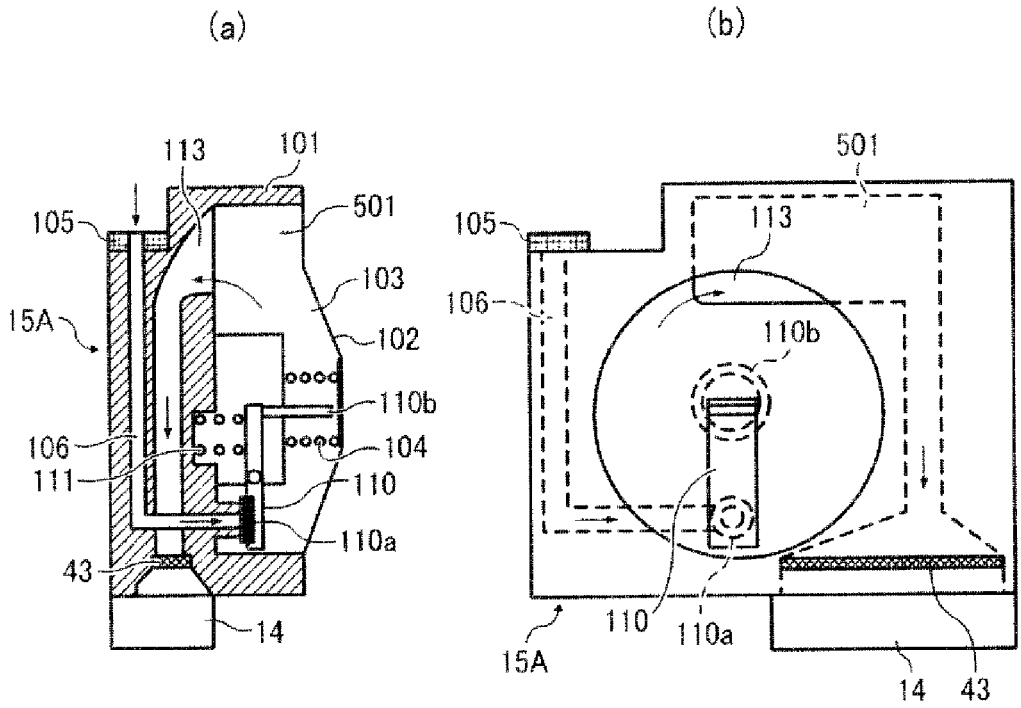
FIGS. 13*a* and 13*b* are schematic views of a sub tank (liquid container) according to a comparative example.

To better and further illustrate the effect of the present exemplary embodiment, a sub tank (liquid container) 15A according to a comparative example is described with reference to FIGS. 13*a* and 13*b*. In the following description, the same reference characters are allocated to members corresponding to those described above and redundant descriptions thereof are omitted below. In addition, the sub tank 15A includes only the first delivery channel 113 as a liquid deliver channel to supply ink from the storage chamber 103 to the recording head 14, and an air storage area 501 that stores bubbles (air) at an upper portion of the storage chamber 103.

The air storage area 501 traps bubbles that may enter the sub tank 15 in long-time use and has sufficient space so that air stored in the upper portion of the sub tank 15 by buoyant force does not shut off the first delivery channel 113 to block ink flow.

When initial ink filling is performed on the sub tank 15A, as described above, a filler liquid in the recording head 14 and the sub tank 15 is suctioned from nozzles of the recording head 14 and replaced with ink.

At this time, since ink flow is slow and stagnant at an upper portion of the air storage area 501, the filler liquid may not mix well with ink, making it difficult to fully replace the filler liquid with ink. Consequently, the sub tank 15A according to the comparative example needs to be upsized to ensure a sufficient space to the air storage area 501. Further, there is the challenge that the amount of waste ink may increase in replacing the filler liquid with ink.

By contrast, the sub tank according to the above-described exemplary embodiment includes the storage chamber to store externally supplied liquid, the first delivery channel through which liquid is supplied from the storage chamber to the recording head, and the second delivery channel through which liquid is supplied from the storage chamber to the recording head. The inlet of the second delivery channel is disposed lower than the inlet of the first delivery channel in the height direction of the storage chamber. For such a configuration, a portion of the liquid storage area above the second delivery channel can serve as the air storage area in which air entering from the exterior is stored. Accordingly, such a configuration can allocate sufficient space to the air storage area without increasing the size of the sub tank (liquid container) and enhance the efficiency of replacing a filler liquid with a recording liquid when the sub tank and the recording head are initially filled with the recording liquid.

Next, a sub tank (liquid container) 15 according to a second exemplary embodiment is described with reference to FIGS. 10*a* and 10*b*.

Figure 10:
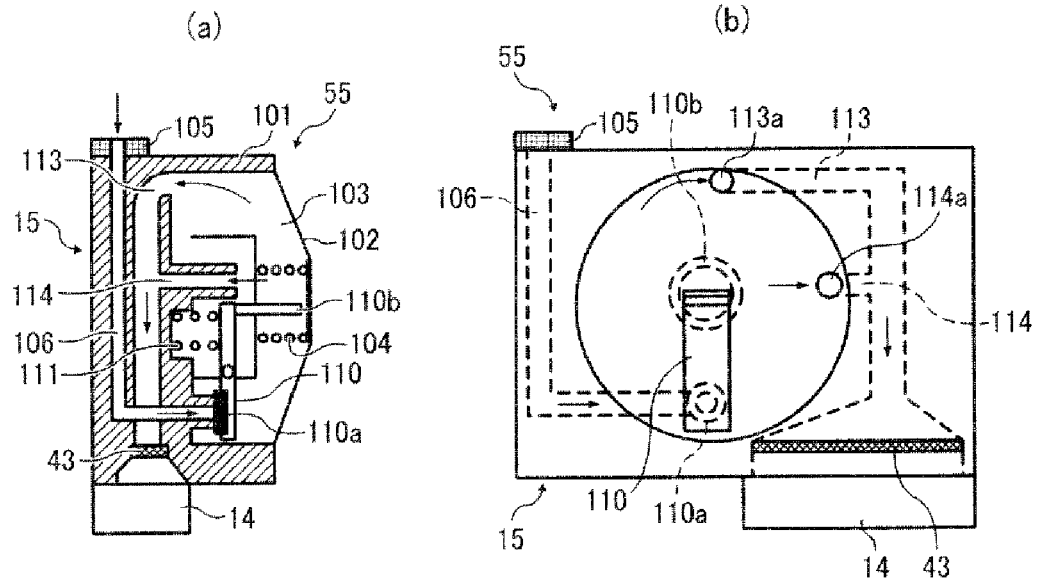
FIGS. 10*a* and 10*b* are schematic views of a sub tank (liquid container) according to a second exemplary embodiment of the present disclosure.

As illustrated in FIGS. 10*a* and 10*b*, the second delivery channel 114 according to the second exemplary embodiment is longer than that according to the first exemplary embodiment, thereby providing an increased fluid resistance. The fluid resistance of the second delivery channel 114 is greater than the fluid resistance of the first delivery channel 113, which is the same as the first exemplary embodiment. The sub tank according to the second exemplary embodiment can provide effects equivalent to the above-described effects provided by that of the first exemplary embodiment.

Figure 11:
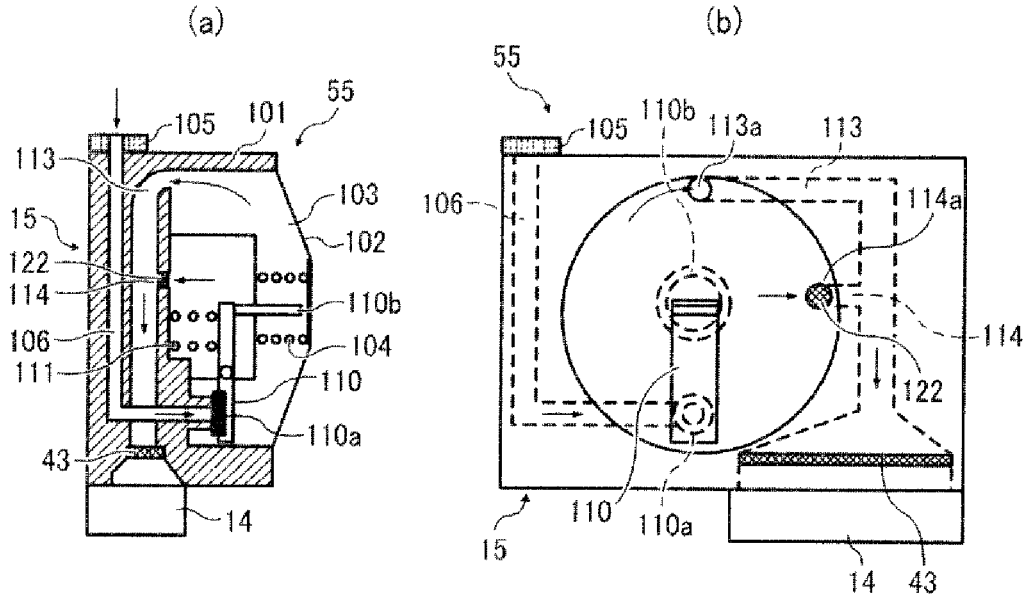
FIGS. 11*a* and 11*b* are schematic views of a sub tank (liquid container) according to a third exemplary embodiment of the present disclosure.

Next, a sub tank (liquid container) 15 according to a third exemplary embodiment is described with reference to FIGS. 11*a* and 11*b*.

In the third exemplary embodiment, the second delivery channel 114 includes a second filter 122 that filters foreign substance. Since the second filter 122 creates fluid resistance, such a configuration allows the fluid resistance of the second delivery channel 114 to be greater than that of the first delivery channel 113 and foreign substance to be removed with a simple structure. Thus, the sub tank according to the third exemplary embodiment can provide effects equivalent to the above-described effects provided by that of the first exemplary embodiment.

Figure 12:
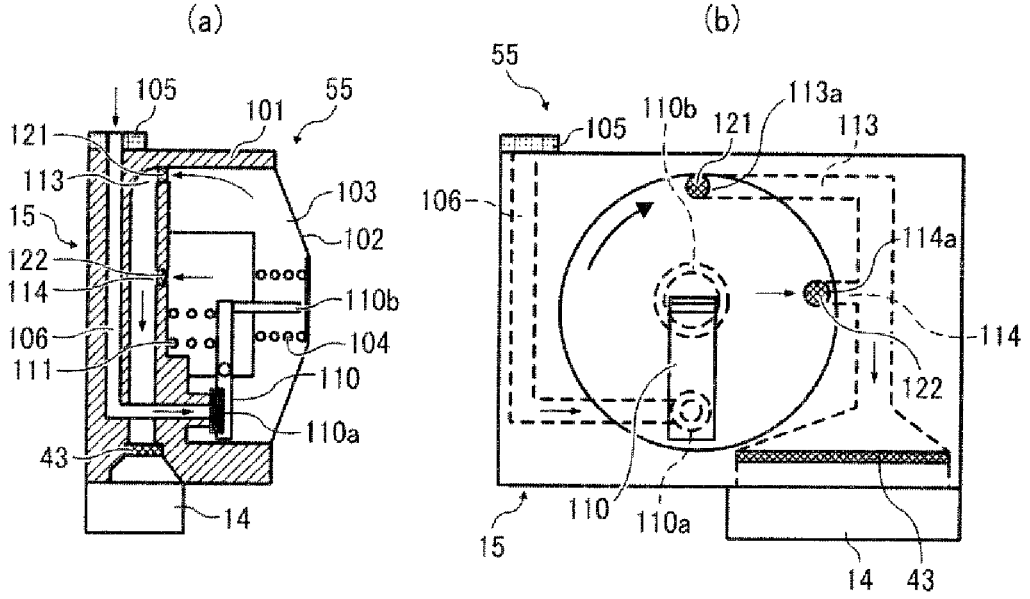
FIGS. 12*a* and 12*b* are schematic views of a sub tank (liquid container) according to a fourth exemplary embodiment of the present disclosure.

Next, a sub tank (liquid container) 15 according to a fourth exemplary embodiment is described with reference to FIGS. 12*a* and 12*b*.

In the fourth exemplary embodiment, the first delivery channel 113 and the second delivery channel 114 include a third filter 121 and a second filter 122, respectively, that filter foreign substance. For such a configuration, the basis weights of the third filter 121 and the second filter 122 are set so that the fluid resistance of the second delivery channel 114 is greater than the fluid resistance of the first delivery channel 113. Thus, foreign substance is removed, and the sub tank according to the fourth exemplary embodiment can provide effects equivalent to the above-described effects provided by that of the first exemplary embodiment.

Numerous additional modifications and variations are possible in light of the above teachings. It is therefore to be understood that within the scope of the appended claims, the present disclosure may be practiced otherwise than as specifically described herein.

With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, elements and/or features of different exemplary embodiments may be combined with each other and/or substituted for each other within the scope of this disclosure and appended claims.

What is claimed is:

1. A liquid droplet ejecting apparatus comprising:

a liquid ejection head to eject liquid for printing;

a sub tank connected to the liquid ejection head to supply the liquid to the liquid ejection head;

a main tank to store the liquid to be supplied to the sub tank; and a supply tube connecting the main tank to the sub tank to supply the liquid from the main tank to the sub tank, wherein the sub tank includes a housing having an opening and a recessed portion, a flexible film sealing the opening of the housing and displaceable with a change in internal pressure of the liquid ejection head due to ink consumption for printing, a first elastic member to urge the flexible film outward;

a liquid storage chamber to store the liquid supplied from the main tank, the liquid storage chamber including an air storage portion in an upper position of the liquid storage chamber in a height direction of the liquid storage chamber to store air, an introduction passage to introduce the liquid supplied from the sub tank to the liquid storage chamber, an opening portion disposed between the introduction passage and the liquid storage chamber, a conjunction valve swingable with the displacement of the flexible film to open and close the opening portion and disposed at a lower position of the liquid storage chamber in the height direction of the liquid storage chamber, the conjunction valve including a pressed portion pressed by the flexible film, a second elastic member to urge the conjunction valve in a direction to close the introduction passage, a first delivery channel having a first inlet at the upper position of the liquid storage chamber in the height direction of the liquid storage chamber to deliver the liquid from the liquid storage chamber to the liquid ejection head, and a second delivery channel having a second inlet at a middle position of the liquid storage chamber in the height direction of the liquid storage chamber to deliver the liquid from the liquid storage chamber to the liquid ejection head while bypassing the first inlet of the first delivery channel, wherein the second inlet of the second delivery channel is positioned lower than the first inlet of the first delivery channel in the height direction of the liquid storage chamber, and by opening the opening portion, the conjunction valve creates two flows of the liquid toward the first delivery channel and the second delivery channel, respectively, in the liquid storage chamber.

2. The liquid droplet ejecting apparatus according to claim 1, wherein an area of the liquid storage chamber higher than the second delivery channel stores air that externally enters the liquid container.

3. The liquid droplet ejecting apparatus according to claim 1, wherein the second delivery channel has a fluid resistance greater than a fluid resistance of the first delivery channel.

4. The liquid droplet ejecting apparatus according to claim 1, further comprising a first filter that filters foreign substance, provided in the second delivery channel.

5. The liquid droplet ejecting apparatus according to claim 4, further comprising a second filter that filters foreign substance, provided in the first delivery channel.

6. An image forming apparatus comprising:

a recording medium feeding section that feeds a recording medium in a feeding direction; and a liquid droplet ejecting apparatus comprising:

liquid for printing on the recording medium;

a sub tank connected to the liquid ejection head to supply the liquid to the liquid ejection head;

a main tank to store the liquid to be supplied to the sub tank; and a supply tube connecting the main tank to the sub tank to supply the liquid from the main tank to the sub tank, wherein the sub tank includes a housing having an opening and a recessed portion a flexible film sealing the opening of the housing and displaceable with a change in internal pressure of the liquid ejection head due to ink consumption for printing, a first elastic member to urge the flexible film outward;

a liquid storage chamber to store the liquid supplied from the main tank, the liquid storage chamber including an air storage portion in an upper position of the liquid storage chamber in a height direction of the liquid storage chamber to store air, an introduction passage to introduce the liquid supplied from the sub tank to the liquid storage chamber, an opening portion disposed between the introduction passage and the liquid storage chamber, a conjunction valve swingable with the displacement of the flexible film to open and close the opening portion and disposed at a lower position of the liquid storage chamber in the height direction of the liquid storage chamber, the conjunction valve including a pressed portion pressed by the flexible film, a second elastic member to urge the conjunction valve in a direction to close the introduction passage, a first delivery channel having a first inlet at the upper position of the liquid storage chamber in the height direction of the liquid storage chamber to deliver the liquid from the liquid storage chamber to the liquid ejection head, and a second delivery channel having a second inlet at a middle position of the liquid storage chamber in the height direction of the liquid storage chamber to deliver the liquid from the liquid storage chamber to the liquid ejection head while bypassing the first inlet of the first delivery channel, wherein the second inlet of the second delivery channel is positioned lower than the first inlet of the first delivery channel in the height direction of the liquid storage chamber, and by opening the opening portion, the conjunction valve creates two flows of the liquid toward the first delivery channel and the second delivery channel, respectively, in the liquid storage chamber.

7. The image forming apparatus according to claim 6, further comprising a suction unit that suctions a filler liquid, not including a colorant, stored in the liquid container from nozzles of the liquid ejection head to replace the filler liquid with another liquid including a colorant.

* * * * *